US005302312A

United States Patent [19]

Kawai et al.

[11] Patent Number: 5,302,312

[45] Date of Patent: Apr. 12, 1994

[54] DETERGENT FOR CONTACT LENS COMPRISING A WATER-SOLUBLE COMPOUND AND A COPOLYMER OF POLYHYDRIC ALCOHOL AND A CROSS-LINKED ACRYLIC ACID AND A METHOD FOR WASHING CONTACT LENS

[75] Inventors: Atsushi Kawai; Megumi Nozawa; Shoko Kanda, all of Nagoya; Kenji Kodama; Hidetake Sendai, both of Tokyo, all of Japan

[73] Assignee: Tomei Sangyo Kabushiki Kaisha, Nagoya, Japan

[21] Appl. No.: 799,861

[22] PCT Filed: Jun. 15, 1989

[86] PCT No.: PCT/JP89/00613

§ 371 Date: Feb. 14, 1990

§ 102(e) Date: Feb. 14, 1990

[87] PCT Pub. No.: WO89/12842

PCT Pub. Date: Dec. 28, 1989

Related U.S. Application Data

[63] Continuation of Ser. No. 465,264, Feb. 14, 1990, abandoned.

[30] Foreign Application Priority Data

Jun. 18, 1988 [JP] Japan ..... 63-150524

[51] Int. Cl.[5] ..... C11D 3/37; C11D 1/12; C11D 1/72

[52] U.S. Cl. ..... 252/106; 252/174.23; 252/174.24; 252/174.17; 252/174.18; 252/DIG. 2; 252/DIG. 15

[58] Field of Search ..... 252/174.17, 174.18, 252/174.23, 174.24, 106, DIG. 2, DIG. 15

[56] References Cited

U.S. PATENT DOCUMENTS

| | | | |
|---|---|---|---|
| 4,394,179 | 7/1983 | Ellis et al. | 134/7 |
| 4,493,783 | 1/1985 | Su et al. | 252/174 |
| 4,534,878 | 8/1985 | Ellis et al. | 252/173 |
| 4,613,379 | 9/1986 | Su et al. | 134/7 |
| 4,655,957 | 4/1987 | Chromecek et al. | 252/174.23 |
| 4,670,060 | 6/1987 | Su et al. | 252/174 |
| 4,734,222 | 3/1988 | Winterton et al. | 252/546 |
| 4,900,366 | 2/1990 | Sibley et al. | 134/42 |

FOREIGN PATENT DOCUMENTS

| | | | |
|---|---|---|---|
| 56-6215 | 1/1981 | Japan . | |
| 57-192922 | 11/1982 | Japan . | |
| 61-72005 | 4/1986 | Japan | 252/174.23 |
| 62-242916 | 10/1987 | Japan . | |
| 1472084 | 4/1977 | United Kingdom . | |

*Primary Examiner*—Paul Lieberman
*Assistant Examiner*—Kery A. Fries
*Attorney, Agent, or Firm*—Armstrong, Westerman, Hattori, McLeland & Naughton

[57] ABSTRACT

A detergent for a contact lens comprising 40 to 80% by weight of fine particles of a water-soluble compound which has a salt value of at most 0.65 and a solubility in water of 3 to 30 at 30° C. and at most 40 at 60° C., with the product of the salt value and the solubility at 30° C. being at most 10, and 100% of which passes a JIS standard sieve of a nominal size of 75 μm, and 60 to 20% by weight of a pasting agent containing as a major component an aqueous dispersion of a gel composed of an acrylic acid compound having a recurring unit represented by the general formula (I):

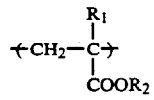

(I)

wherein $R_1$ represents hydrogen atom and/or methyl group, $R_2$ represents at least one member selected from hydrogen atom, sodium atom, potassium atom, lithium atom, $NH_4$ group, a residue of a saturated polyhydric alcohol having 2 to 4 carbon atoms and an alkyl group having 1 to 32 carbon atoms and having a crosslinking site in its recurring unit, and a polyhydric alcohol, and a method for washing a contact lens using the same are disclosed.

3 Claims, No Drawings

DETERGENT FOR CONTACT LENS COMPRISING A WATER-SOLUBLE COMPOUND AND A COPOLYMER OF POLYHYDRIC ALCOHOL AND A CROSS-LINKED ACRYLIC ACID AND A METHOD FOR WASHING CONTACT LENS

This application is a continuation of application Ser. No. 07/465,264 filed Feb. 14, 1990, now abandoned.

TECHNICAL FIELD

The present invention relates to a detergent for a contact lens and a method for washing a contact lens, and more particularly to a detergent for a contact lens useful for removing stains such as protein stuck on a soft contact lens and a method for washing a contact lens.

BACKGROUND ART

As a detergent for a contact lens in which particles are used as a polishing material, a detergent for a contact lens comprising a suspension of particles, which are insoluble in water, in an aqueous solvent such as a suspension of an inorganic material, such as silica or alumina in an aqueous solvent (Japanese Unexamined Patent Publication No. 6512/1981), a suspension of a cellulose in an aqueous solvent (Japanese Unexamined Patent Publication No. 159721/1985), or a suspension of an organic high molecular compound such as polyethylene or polysiloxane in an aqueous solvent, have been known. However, when these detergents are used, there is a necessity to pay attention to rinse the contact lens because particles insoluble in water remain on the surface of the contact lens if the contact lens is not sufficiently rinsed at the time of washing. In particular when a soft contact lens is washed, the particles tend to remain on the surface of the contact lens. Accordingly, the particles are not desirable in view of safety for eyes.

A detergent for a contact lens which is prepared by dispersing particles soluble in water such as sodium chloride or sodium hydrogencarbonate being pulverized to 50 to 200 mesh (mesh, the numerical value is based upon ASTM) as a substance soluble in water into an aqueous solvent when the detergent is used, has been known (specification of U.S. Pat. No. 4,588,444). The detergent has a merit that the preparation time is short. However, there is a necessity to disperse the particles into a solvent just before using the detergent because the particles gradually solve into the solvent, and the effect for washing is not fixed because the particles dissolve into the solvent just after the preparation of the detergent even though the detergent is prepared just before the use and the effect for polishing deteriorates. The combination of the particles soluble in water and an aqueous solvent has to be carried out by the user, and the ratio of the particles and the solvent is different depending upon each user. Accordingly, there is a defect that a large difference in the effect for washing generates among individuals.

In recent years, a detergent for a contact lens prepared by dispersing water-soluble fine particles having a particle diameter of 750 to 1 μm into a nonaqueous water-miscible organic solution has been proposed (Japanese Unexamined Patent Publication No. 242916/1987). However, when the detergent is applied to a water-containing soft contact lens, there are some disadvantages that the lens is dehydrated by the organic solvent and is hardened and that the lens is swelled while the lens is dipped into the detergent for a long period of time. Further, the detergent has a difficulty to be practically used as a detergent for a water-containing soft contact lens because the lens cannot be worn on eyes if the washed lens is not dipped into an isotonic sodium chloride solution and the like for a long period of time.

In consideration of the actual circumstances of the above prior art, the purpose of the present invention is to provide a detergent for a contact lens which exhibits a large effect for washing, which is easily removed from a contact lens, and which does not injure a soft contact lens during washing and does not harden a water-containing soft contact lens.

The present inventors have eagerly investigated in view of the situation that prevention of hardening of a water-containing contact lens at the time of washing is particular important in order to accomplish the above-mentioned purpose. As a result, they have found that the hardening of the lens at the time of washing is caused by the following two factors. The factors are (1) increase of osmotic pressure caused by dissolving fine particles of water-soluble compounds into water at the time of washing, and (2) dehydration of a lens caused by a disperse medium to suspend fine particles of water-soluble compounds and interaction of the disperse medium and the lens.

The present inventors have investigated to remove these factors. As a result, they have found a detergent having no risk of hardening a lens during washing when salt value and solubility in water are adjusted as to the above point (1), and when a composition of which major component is an aqueous dispersion of a gel prepared by the reaction of a mixture of an acrylic acid compound having a cross-linking site as a disperse medium and a polyhydric alcohol is used, and a paste having a high concentration of the water-soluble compound fine particles prepared by mixing the water-soluble compound fine particles of which salt value and solubility are adjusted with the above-mentioned disperse medium is used as to the above point (2), and they have accomplished the present invention.

DISCLOSURE OF THE INVENTION

The present invention relates to (1) a detergent for a contact lens comprising 40 to 80% by weight of fine particles of a water-soluble compound and 60 to 20% by weight of a pasting agent, wherein the water-soluble compound has a salt value of at most 0.65 and a solubility in water of 3 to 30 at 30° C. and at most 40 at 60° C., with the product of the salt value and the solubility at 30° C. being at most 10, and 100% of which passes a JIS standard sieve of a nominal size of 75 μm, and the above-mentioned pasting agent contains as a major component an aqueous dispersion of a gel composed of a polyhydric alcohol and an acrylic acid compound having a recurring unit represented by the general formula (I):

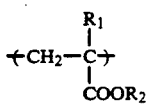

(I)

(wherein $R_1$ represents hydrogen atom and/or methyl group, $R_2$ represents at least one member selected from hydrogen atom, sodium atom, potassium atom, lithium atom, $NH_4$ group, a residue of saturated polyhydric alcohol having 2 to 4 carbon atoms and alkyl group having 1 to 32 carbon atoms) and having a cross linking site in its recurring unit, and (2) a method for washing a contact lens comprising the steps of mixing the above-mentioned detergent for a contact lens with an aqueous solution containing inorganic salts or organic salts, lowering the viscosity of the above-mentioned detergent for a contact lens and after that washing a contact lens.

BEST MODE FOR CARRYING OUT THE INVENTION

The detergent for a contact lens of the present invention comprises 40 to 80% by weight of fine particles of a water-soluble compound and 60 to 20% by weight of a pasting agent.

The fine particles of a water-soluble compound used in the present invention have to satisfy that 100% of which passes a JIS standard sieve of a nominal size of 75 μm (hereinafter "nominal size of xx μm" is merely referred to as "xx μm", and "JIS standard sieve" is merely referred to as "sieve"). When the fine particles have a size such that they do not pass through a sieve of 75 μm, a lens is easy to scratch. The degrees of scratch differ with the kinds of a lens and methods for washing and differ a little with the kinds of the compound. In all cases, it is not preferable that the fine particles have a size such that the fine particles do not pass through a sieve of 75 μm. The fine particles which are in particular preferable are such that 100% of which passes through a sieve of 53 μm, and the fine particles which are most preferable are such that 100% of which passes through a sieve of 32 μm.

It is necessary that the salt value of the water-soluble compound is at most 0.65. When the salt value is more than 0.65, the osmotic pressure is heightened because a part of the water-soluble compound dissolves into water during washing, and thereby the lens is dehydrated and the hardening or changing in size of the lens is apt to occur. It is particularly preferable that the salt value of the water-soluble compound is at most 0.4.

Here, the terminology "salt value" is intended to refer to amount (gram) of sodium chloride showing the same osmotic pressure at which a specific amount (1 gram) of a chemical agent is used. The term "salt value" is sometimes referred to as a "sodium chloride equivalent". See The Merck Index, 9th Ed., p. MISC-72 (1976).

It is also necessary that the solubility of the water-soluble compound in water at 30° C. (hereinafter referred to as "solubility $S^1$") is 3 to 30. When the solubility $S^1$ exceeds 30, there is a risk that a soft contact lens is hardened because a large amount of the fine particles of the water-soluble compound contained in the detergent dissolves into water during washing the lens and the osmotic pressure of water increases even though the salt value of the compound is low. When the solubility $S^1$ is less than 3, after the lens is washed and rinsed, the fine particles of the water-soluble compound is apt to remain on the surface of the lens. The most preferable solubility $S^1$ is 5 to 25.

Here, the terminology "solubility" is intended to refer to amount (gram) of a solute contained in 100 g of a saturated solution.

It is also necessary that the product of the salt value and the solubility $S^1$ is at most 10 so that the lens would not harden. The product of the salt value and the solubility $S^1$ is preferably at most 5 and more preferably at most 3.

It is necessary that the solubility of the water-soluble compound in water at 60° C. (hereinafter referred to as "solubility $S^2$") is at most 40. When the solubility $S^2$ exceeds 40, there are cases where the stability deteriorates at the time of increasing the temperature of the detergent in storage. In other words, since the detergent of the present invention is a pasty material made from the fine particles of the water-soluble compound with a pasting agent containing as a major component an aqueous dispersion of a gel prepared by reacting the mixture of an acrylic acid compound having a cross-linking site and a polyhydric alcohol, when the detergent is transported by, e.g., truck and is exposed to an atmosphere having high temperatures such as about 60° to 80° C., the fine particles dissolve into the pasting agent, and after the detergent is cooled, gross particles precipitate, which cause to scratch the lens during washing.

The water-soluble compound also has to have a high safety for eyes.

Examples of the water-soluble compound which satisfies all of the above requirements are, for instance, L-ascorbic acid, DL-alanine, L-alanine, glycine, taurine, lactose, and the like. Among them, lactose is in particular preferable.

The pasting agent used in the detergent of the present invention contains as a major component an aqueous dispersion of a gel composed of an acrylic acid compound having a recurring unit represented by the general formula (I):

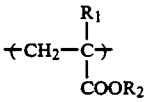

(I)

(wherein $R_1$ represents hydrogen atom and/or methyl group, $R_2$ represents at least one member selected from hydrogen atom, sodium atom, potassium atom, lithium atom, $NH_4$ group, a residue of saturated polyhydric alcohol having 2 to 4 carbon atoms and an alkyl group having 1 to 32 carbon atoms) and having a cross-linking site in its recurring unit, and a polyhydric alcohol.

The acrylic acid compound is prepared by polymerizing, for instance, acrylic acid and/or methacrylic acid and a crosslinking agent in an organic solvent such as benzene with a polymerization initiator soluble in a solvent such as azobisisobutylonitrile. At the time of polymerization, in addition to the acrylic acid and/or methacrylic acid, an alkyl (meth)acrylate represented by the general formula (II):

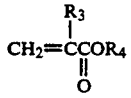

(II)

(wherein $R_3$ represents hydrogen atom or methyl group, and $R_4$ represents an alkyl group having 1 to 32 carbon atoms) is added thereto and they are copolymerized. As the crosslinking agent, for example, a monomer having at least 2 vinyl groups is usually used within an amount of 0.05 to 10% by weight against total amounts of the monomers to be copolymerized. Examples of the monomer having at least 2 vinyl groups are, for instance, ethyleneglycol dimethacrylate, ethyleneglycol diacrylate, diethyleneglycol dimethacrylate, and the like. However, the present invention is not limited to the exemplified ones and it is a matter of course that other monomers can be used.

The saturated polyhydric alcohol having 2 to 4 carbon atoms which is reacted with the acrylic acid compound prepared in the above is partly esterified with carboxyl groups contained in a side chain of polyacrylic acid or polymethacrylic acid (hereinafter referred to as poly(meth)acrylic acid) and partly bonded with a poly(meth)acrylic acid hydroxyalkyl ester by hydrogen bond to form a gel.

The polyhydric alcohol is intended to mean a saturated polyhydric alcohol having 2 to 4 carbon atoms. Examples of the polyhydric alcohol are, for instance, ethylene glycol, propylene glycol, trimethylene glycol, 1,2-butane diol, 1,3-butane diol, 1,4-butane diol, glycerol, butane triol, and the like. Among them, glycerol is in particular preferable.

As a method for preparing a gel comprising the acrylic acid compound and the polyhydric alcohol, a method described in, for instance, Japanese Patent Publication No. 72005/1986 is exemplified. According to the method, a gelatinous reaction product is prepared by stirring a mixture of the acrylic acid compound and a polyhydric alcohol upon heating in an atmosphere of nitrogen gas.

Examples of the aqueous dispersion of the gel are, for instance, an aqueous dispersion prepared by mixing 0.9 part by weight of cross-linkable polyacrylic acid with 66 parts by weight of glycerol and stirring the mixture at 115° C. for 4 hours in an atmosphere of nitrogen gas, and the like. However, the present invention is not limited to the exemplified ones.

It is desirable that the aqueous dispersion of the gel is contained in the pasting agent in an amount of at least 5% by weight, preferably at least 10% by weight. When the content is less than 5% by weight, stability of the detergent, in particular thermal stability deteriorates and the detergent is not put to practical use. It is not preferable that the content exceeds 60% by weight because there is a tendency that a water-containing soft contact lens is hardened when the contact lens is washed with the past alone. However, in case of using the pasting agent by mixing with an aqueous solution of electrolyte or a cleaner for a soft contact lens (an aqueous solution of surface active agent) at washing, the content of the aqueous dispersion of the gel can be adjusted to from more than 60% by weight up to 100% by weight in maximum because the water-containing soft contact lens can be washed without being hardened.

The aqueous dispersion of the gel is dispersed in water in the condition of a microgel and the particle size is usually about 1 μm. Accordingly, the dispersion is observed as a transparent viscous aqueous solution by naked eyes.

The characteristic effect of the aqueous solution of the gel in the pasting agent used in the detergent of the present invention is that the aqueous solution gives stability, in particular thermal stability to the detergent without hardening a water-containing soft contact lens during washing. The above effect exhibited by the aqueous solution is far the better than the effect exhibited by a mere mixture of poly(meth)acrylic acid and poly(meth)acrylic acid sodium and a polyhydric alcohol. The reasons are supposed to as follows. Many hydroxyalkyl groups which are formed by esterifying the acrylic acid compound having a crosslinking site generate intermolecule hydrogen bonds with carboxyl groups and thereby lattices are formed in its molecule.

Water contained in the pasting agent is held in the lattices. These hydroxyalkyl groups also form intermolecule hydrogen bonds and thereby it is supposed that a cage-like lattice structure is formed. Accordingly, water is also strongly held in the lattices between molecules. Such structure is also stable at high temperatures.

Since the detergent is a pasty preparation produced by mixing fine particles of a water-soluble compound with a pasting agent of which major component is water, when the water-soluble compound dissolves into water, e.g., at the time of changing the temperature, and then precipitates, gross particles of the water-soluble compound generate. The gross particles are not adequate for a detergent. However, in the present invention, since the major component of the pasting agent is an aqueous dispersion of the gel, it is supposed that water contained in the pasting agent is stable and the paste for the detergent itself is also stable. It is also supposed that the thermal resistance of the paste for the detergent improves because the above-mentioned lattice structure is stable at high temperatures. It is supposed that the hardening of a water-containing soft contact lens during washing is caused by dehydration of a lens due to a water-miscible non-aqueous organic liquid such as a polyhydric alcohol or by chemical interaction with a lens. However, in the aqueous dispersion of the gel, since a part of the polyhydric alcohol forms an ester bond with a polymer and liberated polyhydric alcohol has a strong interaction with a polymer ester, it is supposed that wrong affections against the hardening of a lens are a little.

It is preferable that a usual surface active agent is added to the pasting agent. As a surface active agent, an agent which is safe for eyes and effective for removing stains such as lipid, and which does not remarkably lower the viscosity when the agent coexists with the gel is used. Examples of the agent are, for instance, polyoxyethylene sorbitan monolaurate, polyoxyethylene sorbitan monooleate, polyoxyethylene sorbitan monostearate, polyethylene-polypropylene block copolymer (Pronone 204; available from Nippon Oil and Fats Co., Ltd., trade name), adduct of polyethylenepolypropylene block copolymer to ethylenediamine (Tetronic TR 701, Tetronic TR 709, respectively, available from ASAHI DENKA KOGYO K.K., trade name), polyoxyethylene sec-alkyl ether, polyoxyethylene nonylphenyl ether, and the like as well as anionic surface active agents such as stearyl phosphate potassium. The amount of the surface active agent cannot be absolutely determined because the amount differs depending upon the kind of the surface active agent. However, the amount is usually at most 5% by weight of the paste.

Other than the above-mentioned components, a water-soluble sequestering agent can be added to the pasting agent in order to prevent adhering inorganic substances onto the surface of a lens. Examples of the sequestering agent are, for instance, EDTA, EDTA sodium salt, EDTA potassium salt, gluconic acid, citric acid, citric acid sodium salt, and the like. The sequestering agent is usually used in an amount of at most 3% by weight of the pasting agent.

To the pasting agent, an antiseptic agent such as sorbic acid, sorbic acid salt, sodium benzoate or p-hydroxybenzoic acid ester can be added. The antiseptic agent is usually used in an amount of at most 2% by weight of the pasting agent.

In the detergent of the present invention, the amounts of the water-soluble compound and the pasting agent are adjusted to 40 to 80% by weight and 60 to 20% by weight, respectively, on the basis of the total amount of the detergent. When the amount of the water-soluble compound is less than 40% by weight, that is, the amount of the pasting agent exceeds 60% by weight, fine particles dissolve into water at the time of the change of the temperature of the detergent and then gross particles precipitate, and thereby a lens might be scratched during washing. When the amount of the water-soluble compound exceeds 80% by weight, that is, the amount of the pasting agent is less than 20% by weight, it comes to be difficult to prepare a paste. The amounts of the water-soluble compound and the pasting agent differ depending upon the components of the pasting agent. However, the preferable amounts of the water-soluble compound and the pasting agent are 70 to 52% by weight and 48 to 30% by weight, respectively.

When a contact lens is washed with the detergent of the present invention, the lens can be washed by, for instance, applying the detergent to the lens, putting the lens onto a palm or the like and rubbing the lens with a fingertip. When a soft contact lens is washed, it is preferable that the contact lens is washed with a puff made of a sheet-like sponge.

The detergent for a contact lens of the present invention can be subjected to washing after the detergent is mixed with an aqueous solution of an electrolyte, a solution having a small pH or a solution having a large pH to lower the viscosity of the detergent at using, or after a puff is impregnated with an aqueous solution of an electrolyte, and a solution having a small pH or a solution having a large pH and further the puff is impregnated with the detergent of the present invention to wash a lens. As mentioned above, it is preferable that the detergent for a contact lens of the present invention is mixed with the above-mentioned aqueous solution of an electrolyte and the like because the viscosity of the detergent is immediately lowered and the washing property is improved in the state that the water-soluble fine particles contained in the detergent are not dissolved into water and the sufficient polishing effect is maintained. The aqueous dispersion contained in the detergent for a contact lens of the present invention has a characteristic that the viscosity is remarkably lowered by shrinking when a large change of pH is imparted to the dispersion by adding, for instance, a solution having a pH of at most 5 or at least 10 thereto, or an aqueous solution of an electrolyte is added thereto. Among the aqueous solution of an electrolyte, a solution having a small pH and a solution having a large pH, it is preferable that the aqueous solution of an electrolyte is used in consideration of the safety for human body, the affection to a lens, and the like.

As an electrolyte used in an aqueous solution of an electrolyte, any of organic compounds and inorganic compounds are used. However, in the present invention, it is preferable to use inorganic compounds such as sodium chloride, calcium chloride and magnesium sulfate. As the above-mentioned aqueous solution of the electrolyte, an aqueous solution of an electrolyte containing divalent metal such as calcium or magnesium is particularly preferable in the present invention.

The higher the concentration of the aqueous solution of an electrolyte is, the degree of shrinkage of a gel is enlarged. However, in consideration of the affection to a soft contact lens and safety for human body, it is desirable that the concentration is not so high, and it is preferable that the concentration is adjusted so that the osmotic pressure of the aqueous solution of an electrolyte is usually almost equal to the osmotic pressure of the aqueous dispersion of a gel. As such an aqueous solution of an electrolyte, for instance, a physiological saline, 5% of an aqueous solution of magnesium sulfate, and the like are exemplified. A surface active agent can also be added to the aqueous solution of an electrolyte as occasion demands.

When the detergent of the present invention contains a surface active agent, the detergent is put onto a puff in an amount being necessary for washing, and is uniformly spread it over the puff with a fingertip, and then the inside and outside of the lens are rubbed to wash with contacting the soft contact lens to the surface of the puff.

When the detergent of the present invention does not contain a surface active agent, a water-containing puff is wrung stiffly and a commercially available detergent for a soft contact lens containing a surface active agent (for instance, trade name: MENI CLEAN available from Menicon Co., Ltd., trade name: SOFPAL available from SEED Co., Ltd. and the like) is put onto the puff, and after the commercially available detergent bubbles with a fingertip, a necessary amount of the detergent for washing is put onto the puff and the lens is rubbed with the puff for washing.

A method for washing a contact lens with a puff is not limited to a method for washing a lens with a fingertip, and a method for using a various washer which is constituted so that a soft contact lens is put between two sheets of water-containing puffs and both surfaces of the lens are contacted with the detergent of the present invention, and the like are exemplified.

The detergent of the present invention is effective for various contact lenses. Among the contact lenses, the detergent is particularly effective for water-containing soft contact lenses. Also, the detergent can be applied to the other non water-containing soft contact lenses made of rubber.

Next, the detergent for a contact lens and a method for washing of the present invention are explained in detail on the basis of examples. However, the present invention is not limited to only the examples.

EXAMPLE 1

Lactose available from Japanese pharmacopeia (monohydrate, salt value: 0.08, solubility $S^1$:19.0, product of salt value and solubility $S^1$:1.52, solubility $S^2$:37) was passed through a sieve of 32 μm and the lactose passed through the sieve was collected. On the other hand, 29 parts by weight of an aqueous dispersion of a gel prepared by reacting crosslinkable polyacrylic acid with glycerol (available from Showa Denko K.K.) as an aqueous dispersion of a gel, 71 parts by weight of purified water and 0.25 part by weight of polyoxyethylene sec-alkyl ether (available from Matsumoto Yushi-Seiyaku Co., Ltd., article No.: NYN-76, oxyethylene 7 moles, number of carbon atoms of alkyl group 12 to 14) were mixed and dissolved to give a transparent gelatinous pasting agent. The amount 12 g of the above-mentioned lactose which was passed through the above-mentioned sieve was taken, to which 8 g of the above-mentioned pasting agent was added and the mixture was sufficiently kneaded to give a pasty detergent. After this detergent was put into a vessel with a cover and was treated in a hot air dryer at 80° C. for 8 hours, the detergent was allowed to stand at room temperature for 12 hours. There was observed no change in the appearance of the detergent at all. When about 1 g of the thermally treated detergent was put onto a puff (available from Menicon Co., Ltd. under the trade name: Menicon PUFF) which was impregnated with water and was uniformly extended with a forefinger, the detergent was very smooth and no generation of gross particles was observed at all.

Next, the detergency of the obtained detergent was examined by the following methods.

A water-containing soft contact lens (available from Menicon Co., Ltd., under the trade name: Menicon soft M) was boiled in 5 ml of an artificial tear liquid per one contact lens for 30 minutes, and then the contact lens was washed with rubbing on the Menicon PUFF, which was impregnated with water, with a detergent (available from Menicon Co., Ltd., under the trade name: MENI CLEAN). After this cycle was repeated 3 times, the lens was boiled in 5 m: of an artificial tear liquid for 30 minutes per one lens, and was rinsed with physiological saline solution, adhered excess protein was removed by a fingertip, and the lens was dried to give an artificial cloudy lens. The used artificial tear liquid contained 9.00 mg of sodium chloride, 1.20 mg of lysozyme, 3.88 mg of albumin, 1.61 mg of γ-globulin, 1.04 mg of sodium dihydrogenphosphate (dihydrate) and 0.15 mg of calcium chloride (dihydrate) per 1 ml of the artificial tear liquid, and pH was adjusted to be 7.0 with sodium hydroxides.

After the above-mentioned dried artificial cloudy lens was stored, the lens was dipped into the physiological saline solution for at least one hour to give a lens for test.

The detergent of the present invention in an amount of about 1.5 g was put onto the water-containing puff which was used at the time of the above-mentioned puff washing and was extended uniformly by fingers, and then the bubble was formed. The above-mentioned lens for test was put onto this puff and a front side and reverse side of the lens were washed with rubbing 5 times by a forefinger, respectively. The washed lens was sufficiently rinsed with purified water, and water attached to the lens was removed with a sheet of non-woven fabric (available from Jujo-kimberly Co., Ltd., under the trade name: Kimwipe) and the lens was air-dried for 10 minutes. The condition of removed stain was examined by observing this lens with a stereomicroscope with a magnification of 16 times. Whether the hardening of the lens was occurred or not, was examined just after the lens was rinsed by a sensory test. The results are shown in Table 1.

Then, after the same procedures as mentioned above were repeated except that a front side and reverse side of the lens for test were washed with rubbing 120 times, respectively instead that a front side and reverse side of the lens were washed with rubbing 5 times, respectively, the generation of scratch was observed with a stereomicroscope with a magnification of 16 times. The results are shown in Table 1.

The detergency was excellent and there was no generation of scratch and no hardening of the lens just after being rinsed was observed at all.

EXAMPLE 2

The amount 20 parts by weight of an aqueous dispersion of a gel prepared by reacting a crosslinkable polymethacrylic acid and 1,3-butanediol (available from Showa Denko K. K.), 80 parts by weight of purified water and 0.3 part by weight of sorbitan monolaurate (available from Wako Purechemical Industries, Ltd.) were mixed and dissolved to give a gelatinous pasting agent. The amount 12 g of lactose which was passed through a sieve being the same as that used in Example 1 was taken and thereto 7 g of the above-mentioned pasting agent was added, and the mixture was sufficiently kneaded to give a pasty detergent. When the detergency of the detergent was examined in the same manner as in Example 1, the change in appearance caused by thermal treatment and the generation of gross particles were not observed. The results of the test for detergency are shown in Table 1.

EXAMPLE 3

Lactose available from Japanese pharmacopeia was passed through a sieve of 53 μm and the lactose passed through the sieve was collected.

The amount 45 parts by weight of an aqueous dispersion of a gel prepared by reacting a partial sodium salt of a crosslinkable polyacrylic acid and glycerol (available from Showa Denko K. K.), 55 parts by weight of purified water, 0.2 part by weight of Pronone 208 (available from Nippon Oil and Fats Co., Ltd.), 0.3 part by weight of potassium sorbate and 0.07 part by weight of EDTA trisodium salt were mixed and dissolved to give a gelatinous pasting agent. The amount 12 g of lactose was taken and thereto 9 g of the above-mentioned pasting agent was added, and the mixture was sufficiently kneaded to give a pasty detergent. The stability of the detergent was examined in the same manner as in Example 1, and as a result, changes caused by thermal treatment were not observed.

EXAMPLE 4

The amount 50 parts by weight of an aqueous dispersion of a gel (available from Showa Denko K. K.) which was the same as that used in Example 1, 0.3 part by weight of Pronone 208 (available from Nippon Oil and Fats Co., Ltd.) and 0.1 part by weight of propyl p-hydroxybenzoate were mixtured and dissolved to give a gelatinous pasting agent. The amount 12 g of lactose which was passed through a sieve being the same as that used in Example 1 was taken and thereto 9 g of the above-mentioned pasting agent was added, and the mixture was sufficiently kneaded to give a pasty detergent. Although the stability of the detergent was examined in the same manner as in Example 1, changes caused by thermal treatment were not observed. Next, in order to examine the detergency, the following lens for test was produced.

At first, an artificial tear liquid was prepared from the following components.

| | |
|---|---|
| Sodium chloride | 0.83 g |
| Lysozyme | 0.129 g |
| Albumin | 0.394 g |
| γ-Globulin | 0.275 g |
| Sodium dihydrogenphosphate (dihydrate) | 0.08 g |
| Calcium chloride (dihydrate) | 0.022 g |
| Mucin (gastric mucosa) | 0.15 g |
| 1N of Sodium hydroxide | 0.3 ml |
| Water | 100 ml |

Next, after a non water-containing soft contact lens of which main components were butyl acrylate and butyl methacrylate (available from RICKY CONTACT LENS INC., under the trade name: SOPHINA) was boiled in the prepared artificial tear liquid for 15 minutes, the lens was washed on a puff for washing (available from Menicon Co., Ltd., under the trade name: Menicon PUFF) with a detergent (available from Menicon Co., Ltd., under the trade name: MENI CLEAN). When the above procedure was repeated 3 times, protein was adhered on the whole surface of the lens.

Next, the above-mentioned detergent was used in an amount of about 0.7 g, and the lens for test was washed with rubbing on a palm for about 15 minutes. When the washed lens was rinsed with purified water, and the lens was observed in the same manner as in Example 1, stains were almost completely removed. On the other hand, when a lens for test prepared in the same manner as mentioned above was washed with a conventional liquid detergent (available from Menicon, Co., Ltd. under the trade name: MENI CLEAN) in the same manner as mentioned above, it was observed that many stains remained.

The results of the test for detergency are shown in Table 1.

EXAMPLE 5

L-ascorbic acid (special grade chemical, salt value 0.18, solubility $S^1$: 21.3, product of salt value and solubility $S^1$: 3.8, solubility $S^2$; 29.7) was passed through a sieve of 53 μm and the L-ascorbic acid passed through the sieve was collected. From the L-ascorbic acid, 12 g thereof was taken and thereto 6.5 g of the pasting agent prepared in Example 1 was added, and the mixture was sufficiently kneaded to give a pasty detergent. When the stability of this detergent was examined in the same manner as in Example 1, no change caused by thermal treatment observed. The results of the test for detergency are shown in Table 1.

EXAMPLE 6

Glycine (special grade chemical, salt value: 0.27, solubility $S^1$:21.6, product of salt value and solubility $S^1$: 6.6, solubility $S^2$: 31.2) was passed through a sieve of 38 μm and the glycine passed through the sieve was collected. From this glycine, 12 g thereof was taken and thereto 6.5 g of the pasting agent prepared in Example 1 was added, and the mixture was sufficiently kneaded to give a pasty detergent. When the stability of this detergent was observed in the same manner as in Example 1, no change caused by thermal treatment was observed. The results of the test for detergency are shown in Table 1.

EXAMPLE 7

Lactose available from Japanese pharmacopia (monohydrate, salt value: 0.08, solubility $S^1$: 19.0, product of salt value and solubility $S^1$: 1.52, solubility $S^2$: 37) was passed through a sieve of 32 μm and the lactose passed through the sieve was collected. On the other hand, 29 parts by weight of an aqueous dispersion of a gel prepared by reacting a cross-linkable polymer prepared by reacting 100 parts by weight of acrylic acid, 5 parts by weight of stearyl methacrylate and a small amount of a crosslinking agent, with glycerol as an aqueous dispersion of a gel, 71 parts by weight of purified water and 0.25 part by weight of polyoxyethylene sec-alkyl ether (available from Matsumoto Yushi-Seiyaku Co., Ltd., article No. : NYN-76, oxyethylene 7 moles, number of carbon atoms of alkyl group 12 to 14) were mixed and dissolved to give a transparent gelatinous pasting agent. From the above-mentioned lactose which was passed through a sieve, 12 g thereof was taken and thereto 8 g of the above-mentioned pasting agent was added, and the mixture was sufficiently kneaded to give a pasty detergent. After this detergent was put into a vessel with a cover and was treated in a hot air drier at 80° C. for 8 hours, the detergent was allowed to stand at room temperature for 12 hours. There was observed no change in appearance of the detergent. When about 1 g of the thermally treated detergent was put onto a puff (available from Menicon Co., Ltd. under the trade name: Menicon PUFF) which was inpregnated with water and was uniformly extended with a forefinger, the detergent was very smooth and no generation of gross particles was observed at all. The results of the test for detergency are shown in Table 1.

EXAMPLE 8

Lactone available from Japanese pharmacopeia (monohydrate, salt value: 0.08, solubility $S^1$:19.0, product of salt value and solubility $S^1$: 1.52, solubility $S^2$: 37) was passed through a sieve of 32 μm and the lactose passed through the sieve was collected. On the other hand, 29 parts by weight of an aqueous dispersion (available from Showa Denko K.K.) prepared by reacting a crosslinkable polymer prepared by polymerizing 100 parts by weight of acrylic acid, 5 parts by weight of lauryl acrylate and a small amount of a crosslinking agent, with glycerol, 71 parts by weight of purified water and 0.25 part by weight of polyoxyethylene sec-alkyl ether (available from Matsumoto Yushi-Seiyaku Co., Ltd., article No.: NYN-76, oxyethylene 7 moles, number of carbon atoms of alkyl group 12 to 14) were mixed and dissolved to give a transparent gelatinous pasting agent. From the lactose passed through the sieve, 12 g thereof was taken and thereto 8 g of the above-mentioned pasting agent was added, and the mixture was sufficiently kneaded to give a pasty detergent. After this detergent was put into a vessel with a cover and was treated in a hot air drier at 80° C. for 8 hours, the detergent was allowed to stand at room temperature for 12 hours. There was observed no change in appearance of the detergent at all. When about 1 g of the thermally treated detergent was put onto a puff (available from Menicon Co., Ltd. under the trade name: Menicon PUFF) which was penetrated with water and was uniformly extended with a forefinger, the detergent was very smooth and no generation of gross particles was observed at all. The results of the test for detergency are shown in Table 1.

EXAMPLE 9

There was a gelatinous pasting agent prepared by mixing and dissolving 60 parts by weight of the dispersion of a gel obtained in Example 1, 40 parts by weight of purified water and 1 part by weight of polyoxyethylene (20 moles) sorbitan monolaurate (available from Wako Purechemical Industries, Ltd.). Then 12 g of lactose which was passed through a sieve being the same as that used in Example 1 was prepared and thereto 8 g of the above-mentioned pasting agent was added, and the mixture was sufficiently kneaded to give a pasty detergent.

When the detergent was put onto a puff (available from Minicon Co., Ltd. under the trade name of Menicon PUFF) which was beforehand impregnated with physiological saline solution at the time of washing a lens with this detergent and the lens was washed, the viscosity of the detergent was rapidly lowered in comparison with the case where a puff which was impregnated with purified water was used, and the detergency such as slipping and foaming was improved. The results of the test for detergency are shown in Table 1.

EXAMPLE 10

When a puff (available from Menicon Co., Ltd. under the trade name of Menicon PUFF) was beforehand impregnated with 5% aqueous solution of magnesium sulfate and onto which a pasty detergent being the same as that used in Example 9 was put at the time of washing with the detergent, and then the washing was carried out, the viscosity was rapidly lowered in comparison with the case where the puff was impregnated with purified water was used, and the detergency such as slipping and foaming was improved. The results are shown in Table 1.

EXAMPLE 11

There was obtained a gelatinous pasting agent by mixing and dissolving 90 parts by weight of an aqueous dispersion of a gel being the same as that used in Example 1, 10 parts by weight of purified water, 1 part by weight of polyoxyethylene (20 moles) sorbitan monolaurate (available from Wako Purechemical Industries, Ltd.) and 10 parts by weight of isopropanol. Lactose which was passed through a sieve being the same as that used in Example 1 in an amount of 12 g was prepared and thereto 9 g of the above-mentioned pasting agent was added, and the mixture was kneaded to give a pasty detergent. Although the stability of the detergent was examined in the same manner as in Example 1, no change caused by thermal treatment was observed.

The detergency was excellent and no scratch generated, and further the hardening of a lens just after rinsing was not observed at all. The results of the test for detergency are shown in Table 1.

EXAMPLE 12

Lactose available from Japanese pharmacopeia was passed through a sieve of 53 μm and the lactose passed through the sieve was collected.

There was obtained a gelatinous pasting agent by mixing and dissolving 45 parts by weight of aqueous dispersion of a gel (available from Showa Denko K.K.) prepared by reacting a partial sodium salt of a crosslinkable polyacrylic acid and glycerol, 55 parts by weight of purified water and 1 part by weight of polyoxyethylene nonylphenyl ether (available from Nippon Oil and Fats Co., Ltd. under the trade name: HS-220). From the lactose, 12 g thereof taken and thereto 9 g of the above-mentioned pasting agent was added, and the mixture was sufficiently kneaded to give a pasty detergent. Although the stability of the detergent was examined, change caused by thermal treatment was not observed. The results of the test for detergency are shown in Table 1.

COMPARATIVE EXAMPLE 1

Glucose (special grade chemical, salt value: 0.18, solubility $S^1$: 67, product of salt value and solubility $S^1$: 12, solubility $S^2$ 74) was passed through a sieve of 53 μm, and the glucose passed through the sieve was collected. From the glucose, 12 g thereof was taken and thereto 8 g of the pasting agent prepared in Example 1 was added, and the mixture was sufficiently kneaded to give a pasty detergent. When the stability of this detergent was examined in the same manner as in Example 1, all of the fine particles were dissolved by a thermal treatment and a transparent solution was formed. Therefore, the detergent was in the state where the detergency due to the fine particles was not exhibited.

COMPARATIVE EXAMPLE 2

Sucrose (special grade chemical, salt value: 0.08, solubility $S^1$: 68, product of salt value and solubility $S^1$: 5.4, solubility $S^2$: 74) was passed through a sieve of 38 μm, and the scrose passed through the sieve was collected. From the scrose, 12 g thereof was taken and thereto 8 g of the pasting agent prepared in Example 1 was added, and the mixture was sufficiently kneaded to give a pasty detergent. When the stability was examined in the same manner as in Example 1, all of the fine particles were dissolved by a thermal treatment and a transparent solution was formed.

COMPARATIVE EXAMPLE 3

When lactose (monohydrate) available from Japanese pharmacopeia was passed through a sieve of 150 μm, about 20% thereof was not passed through the sieve. Before the lactose was passed through this sieve, 12 g of the lactose was taken and, thereto 8 g of the pasting agent prepared in Example 1 was added, and the mixture was sufficiently kneaded to give a pasty detergent. With respect to the detergent, the test for detergency was carried out in the same manner as in Example 1. The results are shown in Table 1.

Although the detergency was good and the hardening of a lens did not generate, small scratches generated on the lens.

COMPARATIVE EXAMPLE 4

Lactose which was passed through a sieve of 32 μm being the same as that used in Example 1 was taken in an amount of 12 g and thereto 25 g of the pasting agent prepared in Example 2 was added, and the mixture was sufficiently kneaded to give a liquid detergent. When this detergent was put into a vessel with a cover, and a test for stability was carried out in the same manner as in Example 1 to examine the thermal resistance, growth of gross particles was observed. Therefore, it was recognized that the detergent was inadequate for a detergent for a lens.

COMPARATIVE EXAMPLE 5

A pasting agent was prepared by mixing and dissolving 2 parts by weight of the aqueous dispersion of a gel obtained in Example 1 and 98 parts by weight of purified water. Lactose which was passed through a sieve being the same as that used in Example 1 was taken in an amount of 12 g and thereto 7 g of the above-mentioned pasting agent was added, and the mixture was kneaded to give a pasty detergent. When the stability of the detergent was examined in the same manner as in Example 1, growth of gross particles was observed. Therefore, it was recognized that the detergent was inadequate for a detergent for a lens.

COMPARATIVE EXAMPLE 6

A pasting agent was prepared by mixing and dissolving 20 parts by weight of glycerol and 80 parts by weight of purified water. Lactose which was passed through a sieve being the same as that used in Example 1 was taken in an amount of 12 g and thereto 7 g of the above-mentioned pasting agent was added, and the mixture was kneaded to give a pasty detergent. When the stability of the detergent was examined in the same manner as in Example 1, generation of gross particles due to thermal treatment was recognized, and it was found that the detergent was inadequate for a detergent for a lens.

COMPARATIVE EXAMPLE 7

After about 0.5 ml of a commercially available liquid-detergent for a contact lens (available from Menicon Co., Ltd. under the trade name of MENI CLEAN) which does not contain fine particles of a water-soluble compound but contains a surface active agent and an aqueous high molecular compound as a thickener was put onto a puff for washing being the same as that used in Example 1 and foam was generated by a finger, the test for detergency was carried out against a lens for test in the same manner as in Example 1. As the results, the detergency was poor as shown in Table 1.

COMPARATIVE EXAMPLE 8

A pasting agent was prepared by mixing and dissolving 10 parts by weight of the aqueous dispersion of a gel (available from Showa Denko K.K.) used in Example 1, 45 parts by weight of purified water and 0.3 part by weight of Pronone 208 (available from Nippon Oil and Fats Co., Ltd.).

Lactose which was passed through a sieve being the same as that used in Example 1 was taken in an amount of 12 g and thereto 8 g of the above-mentioned pasting agent was added, and the mixture was sufficiently kneaded to give a pasty detergent. When the stability of the detergent was examined in the same manner as in Example 1, generation of gross particles was not recognized and it was found that the thermal treatment could be conducted. Next, the test for detergency was carried out in the same manner as in Example 1. The results are shown in Table 1.

When the lens was washed, the hardening of the water-containing soft contact lens generated.

COMPARATIVE EXAMPLE 9

A pasty detergent was prepared in the same manner as in Example 3 except that as aqueous solution composed of 30 parts by weight of glycerol, 0.45 part by weight of (uncrosslinked) polyacrylic acid, 0.19 part by weight of (uncrosslinked) polyacrylic acid sodium, 4.5 parts by weight of propylene glycol and 14 parts by weight of purified water were used as a pasting agent instead of the aqueous dispersion (available from Showa Denko K.K.) used in Example 1. When the stability of the detergent was examined in the same manner as in Example 1, the detergent was unstable because lactose and the pasting agent were more or less separated. The results of the test for detergency are shown in Table 1.

When the lens was washed, the generation of hardening of the lens was remarkably recognized.

TABLE 1

| Ex. No. | Degree of removing stains | Degree of scratching | Hardening of lens |
|---|---|---|---|
| 1 | ◎ | ○ | ◎ |
| 2 | ◎ | ○ | ◎ |
| 3 | ◎ | ○ | ◎ |
| 4 | ◎ | ○ | — |
| 5 | ○ | ○ | ◎ |
| 6 | ○ | ○ | ◎ |
| 7 | ◎ | ○ | ◎ |

TABLE 1-continued

| Ex. No. | Degree of removing stains | Degree of scratching | Hardening of lens |
|---|---|---|---|
| 8 | ◎ | ○ | ◎ |
| 9 | ◎ | ○ | ○ |
| 10 | ◎ | ○ | ○ |
| 11 | ◎ | ○ | ○ |
| 12 | ◎ | ○ | ◎ |
| Com. Ex. | | | |
| 3 | ◎ | X | ◎ |
| 7 | X | ○ | ◎ |
| 8 | ○ | ○ | X |
| 9 | ◎ | ○ | X |

[Evaluation of the results of the test]
(Degree of removing stains)
◎ : Excellent
○ : Good
X : Wrong
(Degree of scratching)
○ : No scratching
X : Scratching generated
(Hardening of lens)
◎ : No hardening
○ : It tends to be hardened a little, but no problem generates.
X : Hardened As explained above, the detergent for a contact lens of the present invention exhibits very excellent detergency, and sufficiently removes stains due to protein which are not sufficiently removed by conventional liquid detergents and stains due to cosmetic such as eye shadow. Accordingly, the detergent scarecely necessitates proteolytic enzyme.

Since fine particles of a water-soluble compound are used in the detergent for a contact lens of the present invention, a contact lens was washed without the remaining of components of the detergent on the contact lens. Further, even if components of the detergent are remained one the contact lens, it is safe for eyes because no wrong affection is given to eyes.

The detergent of the present invention has an effect that there is no necessity to pay attention, in particular, for the method of storage because stability during storage is excellent and little change in properties generates even if the detergent is exposed to high temperature.

According to the method of washing a contact lens of the present invention, it is recognized that no scratch generates on a lens after washing at all, and the invention has an effect to generate no hardening of a water-containing soft contact lens during washing.

INDUSTRIAL APPLICABILITY

The detergent for a contact lens of the present invention can be preferably used as a detergent for a contact lens having an excellent detergency and easiness to be washed, giving no scratches to a contact lens during washing the contact lens and further not hardening a water-containing soft contact lens.

We claim:

1. A detergent for a contact lens comprising 40 to 80% by weight of fine particles of a water-soluble compound which is safe for eyes and suspended in correspondingly 60 to 20% by weight of a pasting agent, wherein the water-soluble compound has a salt value of at most 0.65 and a solubility in water of 3 to 30 g per 100 g of a saturated solution of the compound at 30° C. to 60° C., with the product of the salt value and the solubility at 30° C. being at most 10, and 100% of which passes a JIS standard sieve of a nominal size of 75 μm, and said pasting agent contains 5 to 100% by weight of an aqueous dispersion of a gel composed of a reaction product of (a) a polyhydric alcohol having 2 to 4 carbon atoms and (b) a crosslinked acrylic acid compound having a crosslinkable recurring unit represented by the general formula (I):

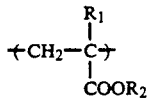

(I)

wherein $R_1$ represents at least one of hydrogen and methyl, $R_2$ represents at least one member selected from the group consisting of hydrogen, sodium, potassium, lithium, $NH_4$, a residue of a saturated polyhydric alcohol having 2 to 4 carbon atoms and alkyl having 1 to 32 carbon atoms.

2. A method for washing a contact lens comprising mixing a detergent for a contact lens comprising 40 to 80% by weight of fine particles of a water-soluble compound which is safe for eyes and suspended in correspondingly 60 to 20% by weight of a pasting agent, wherein the water-soluble compound has a salt value of at most 0.65 and a solubility in water of 3 to 30 grams per 100 g saturated solution at 30° C. to 60° C., with the product of the salt value and the solubility at 30° C. being at most 10, and 100% of which passes a JIS standard sieve of a nominal size of 75 μm, and said pasting agent contains 5 to 100% by weight of an aqueous dispersion of a gel composed of a reaction product of (a) a polyhydric alcohol having 2 to 4 carbon atoms and (b) a crosslinked acrylic acid compound having a crosslinkable recurring unit represented by the general formula (I):

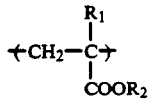

(I)

wherein $R_1$ represents at least one of hydrogen and methyl, $R_2$ represents at least one member selected from the group consisting of hydrogen, sodium potassium, lithium, $NH_4$, a residue of a saturated polyhydric alcohol having 2 to 4 carbon atoms and alkyl having 1 to 32 carbon atoms, with an aqueous solution of an inorganic salt selected from the group consisting of a sodium salt, a calcium salt and a magnesium salt, lowering the viscosity of said detergent for a contact lens and after that washing a contact lens.

3. The detergent of claim 1, wherein $R_2$ is an alkyl group having 1 to 32 carbon atoms.

* * * * *